US007681726B2

(12) United States Patent
O'Donnell et al.

(10) Patent No.: US 7,681,726 B2
(45) Date of Patent: Mar. 23, 2010

(54) APPARATUS FOR INTERNAL MIXTURE OF SUBSTANCES

(76) Inventors: Brian O'Donnell, 7 Exeter Rd., Epping, NH (US) 03042; John Porter, 7 Exeter Rd., Epping, NH (US) 03042

( * ) Notice: Subject to any disclaimer, the term of this patent is extended or adjusted under 35 U.S.C. 154(b) by 734 days.

(21) Appl. No.: 11/504,173

(22) Filed: Aug. 15, 2006

(65) Prior Publication Data

US 2008/0041738 A1 Feb. 21, 2008

(51) Int. Cl.
*B65D 25/08* (2006.01)

(52) U.S. Cl. ..... 206/222

(58) Field of Classification Search ..... 266/219, 266/220, 221, 222
See application file for complete search history.

(56) References Cited

U.S. PATENT DOCUMENTS 3,305,368 A * 2/1967 Bourelle ..... 426/120
3,326,363 A * 6/1967 Bennett et al. ..... 206/219
3,743,520 A * 7/1973 Croner ..... 426/87
3,779,372 A * 12/1973 de Lloret ..... 206/222
3,796,813 A * 3/1974 Kurland ..... 426/86
4,634,003 A * 1/1987 Ueda et al. ..... 206/221
4,784,678 A * 11/1988 Rudick et al. ..... 62/4
4,785,931 A * 11/1988 Weir et al. ..... 206/222
5,035,320 A * 7/1991 Plone ..... 206/219
5,123,574 A * 6/1992 Poulos ..... 222/362
5,431,276 A * 7/1995 Lialin ..... 206/222
5,529,179 A * 6/1996 Hanson ..... 206/219
5,711,420 A * 1/1998 Spring ..... 206/222
5,772,017 A * 6/1998 Kang ..... 206/222
5,885,635 A * 3/1999 Spring et al. ..... 206/222
5,934,493 A * 8/1999 Han ..... 206/222
5,979,647 A * 11/1999 Han ..... 206/222
6,305,576 B1 * 10/2001 Leoncavallo ..... 206/222
6,708,735 B1 * 3/2004 Kenihan ..... 206/222
6,763,939 B2 * 7/2004 Alticosalian ..... 206/222
6,840,373 B2 * 1/2005 Gibler et al. ..... 206/219
6,874,551 B1 * 4/2005 Snell et al. ..... 206/222
6,976,578 B1 * 12/2005 Kenihan ..... 206/222
7,163,129 B1 * 1/2007 Bennett ..... 222/192
7,306,117 B2 * 12/2007 Roth et al. ..... 222/83
2002/0157970 A1 * 10/2002 Carlson ..... 206/222
2007/0074979 A1 * 4/2007 Cho ..... 206/219
2008/0041738 A1 * 2/2008 O'Donnell et al. ..... 206/219
2008/0067084 A1 * 3/2008 Patterson et al. ..... 206/219

OTHER PUBLICATIONS

Ipifini, Inc., Choice Enabling Packaging by Ititini, Sales Brochure, Published on Website 15 pages, copyright 2006.

* cited by examiner

*Primary Examiner*—Tony G Soohoo
(74) *Attorney, Agent, or Firm*—Lambert & Associates; Xiaolei Zhang; Gary Lambert

(57) ABSTRACT

A device for mixture of substances, whether in the form of a fixed or removable cap or in the form of emersion within a container, utilizing individual internal substance containment vessels, controlled by an external actuation mechanism. The system actuation mechanism can be placed in a locked position for storage, shipping or to ensure integrity of solutions. Multiple containment vessels may be utilized, as well as multiple compartments within an individual container to produce multiple mixtures. A further embodiment encompassing a pivotal actuator and removably attached mixing mechanisms is also illustrated.

9 Claims, 12 Drawing Sheets

APPARATUS FOR INTERNAL MIXTURE OF SUBSTANCES

BACKGROUND OF THE INVENTION

1. Field of Invention

The invention relates generally to the field of substance mixture and more specifically fluid or liquid mixture involving within a dispenser.

2. Description of the Related Art

Currently, one design is illustrated by IPIFINI, Inc. at www.ipifini.com which utilizes buttons externally mounted to a soda bottle to mix flavors. However, the IPIFINI design illustrates an entirely different appartus and manner of operation than the instant invention.

BRIEF SUMMARY OF THE INVENTION

The present invention, as described further herein imparts a novel mixture system which encompasses the advantages of other existing mixing systems, but eradicates the inaccuracy and vulnerability. The instant invention, as illustrated herein, is clearly not anticipated, rendered obvious, or even present in any of the prior art mechanisms, either alone or in any combination thereof.

The instant apparatus utilizes a meter dosage mechanism with a plunger. While other devices have revealed simplistic mechanisms involving unprotected vessels externally attached to the outer portions of containers, with no precision measurement possible, the instant invention offers precision measurement as well as applicability to differing containment systems.

Therefore, the instant invention can be adapted to any product that is delivered through a lid, cap, top or bottle. In one embodiment, this instant design can be utilized to introduce multiple differing flavors into bottled water or another fluid through use of an integrated cap or lid. The cap or lid is designed to be packaged a plunger in a neutral position for shipping and thus not accidentally triggering plunger after seal is broken you will index the cap in 90 degree increments to establish the substance or substances to be mixed upon the requirements of the user. The cap can be of a thread, screw on design or molded over a bottle cap that will contains holes and will have the same mechanics as the initial design.

The instant system can also be applied to a can lid with multiple opening and removably attached substance or flavor packets, one for plain beverage and 2 more openings for other flavors. When a user chooses one of the openings, the flavor packets that are placed below will be torn loose, introducing 2 optional flavors.

Thus, the instant cap may used for flavoring alcoholic beverages, citrus products, dairy products or liquid medicines or creating multi scents for cleaners, It can also be used to introducing precision measurements in to epoxies as well as other chemicals.

It is an object of the present invention to provide a new mixing system which has many of the advantages of the mixing system mentioned heretofore and many novel features that result in a new mixing system which is not anticipated, rendered obvious, suggested, or even implied by any of the prior art mixing systems, either alone or in any combination thereof.

Still yet another object of the present invention is to provide a new apparatus for the internal mixture of substances that is easy and convenient to use. Even still another object of the present invention is to provide a new an apparatus for the internal mixture of substances that simplifies the task of mixing substances.

It is an object of the present invention to introduce a novel system for mixture, combination or and admixture of fluids with other fluids or powders or other compounds.

It is an object of the present invention to introduce a novel system for compartmentalized mixture of fluids and thus utilization of more than one flavor independently or together. The contents of the differing compartments may be interspersed at the choice of the user.

It is an object of the present invention to introduce a novel method of mixing fluids wherein complete admixture of substances is guaranteed.

Also, other designs cannot contain certain chemicals for mixing as they would deteriorate the containment system.

There has thus been outlined, rather broadly, the more important features of the mixing system in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

DETAILED DESCRIPTION OF THE INVENTION

Figure 1:
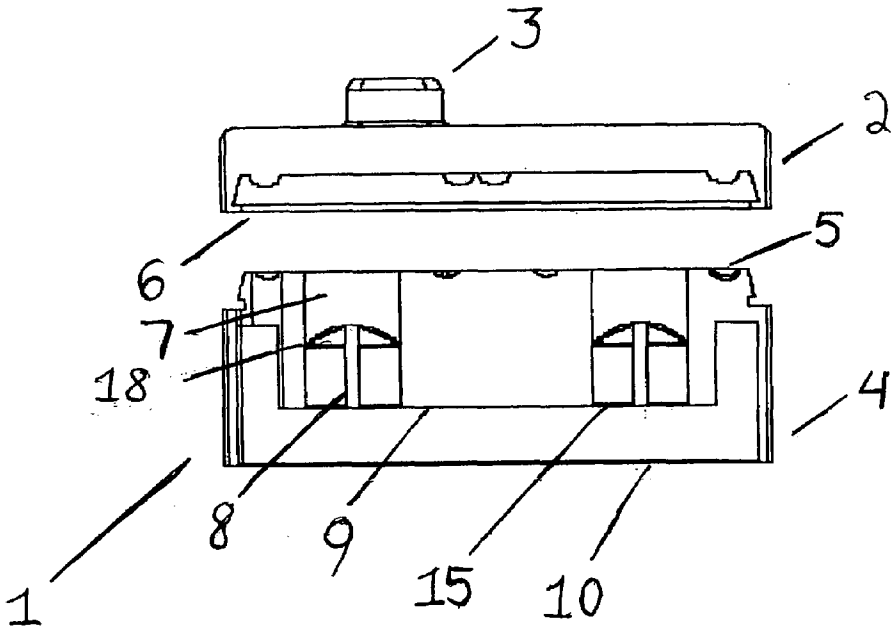
FIG. 1 is a side cross sectional view of the container lid embodiment illustrating the top portion separated from the bottom portion of the instant invention.
Figure 3:
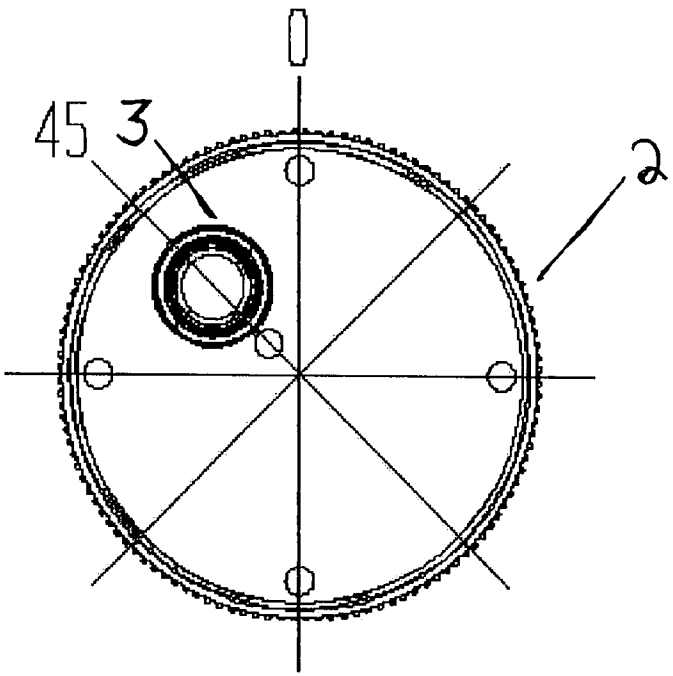
FIG. 3 is a bottom cross sectional view of the bottom portion of the container lid embodiment, illustrating the individual containment vessels.

As shown in FIG. 1-5, in one embodiment of the instant invention, a container lid mechanism 1 for mixture of substances is illustrated comprising: a rotatable top portion 2 comprising an actuator 3; a bottom portion 4 comprising; a top edge 5 of said bottom portion 4 in communication with a bottom edge 6 of said rotatable top portion 2; at least one containment vessel 7; at least one plunger mechanism 8 encased within said containment vessel 7 and the plunger mechanism 8 in communication with actuator 3; a lower edge 9; and, a seal 10 in communication with said lower edge 9.

Figure 2:
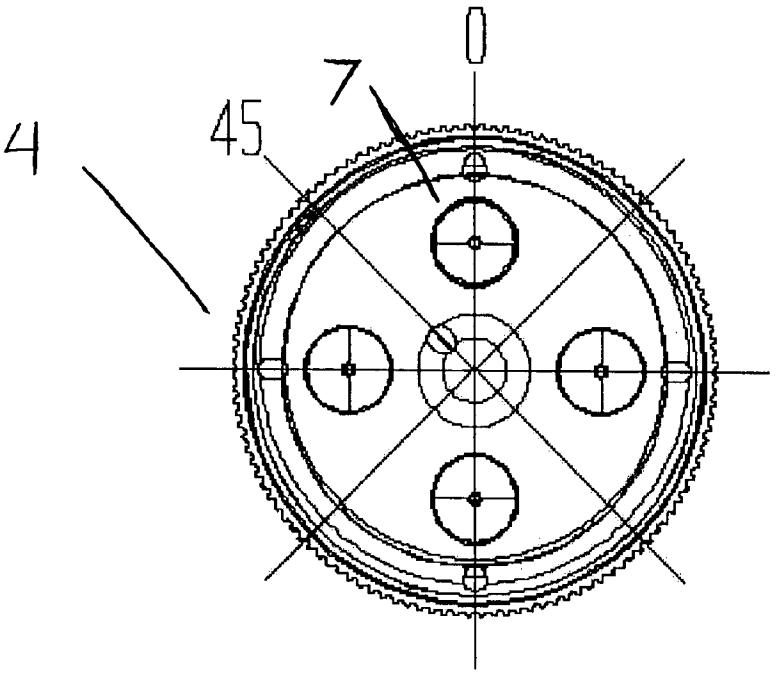
FIG. 2 is a top cross sectional view of the container lid embodiment illustrating the top portion and the actuator mechanism in the shipping position, neutrally located away form any of the corresponding containment vessels.
Figure 4:
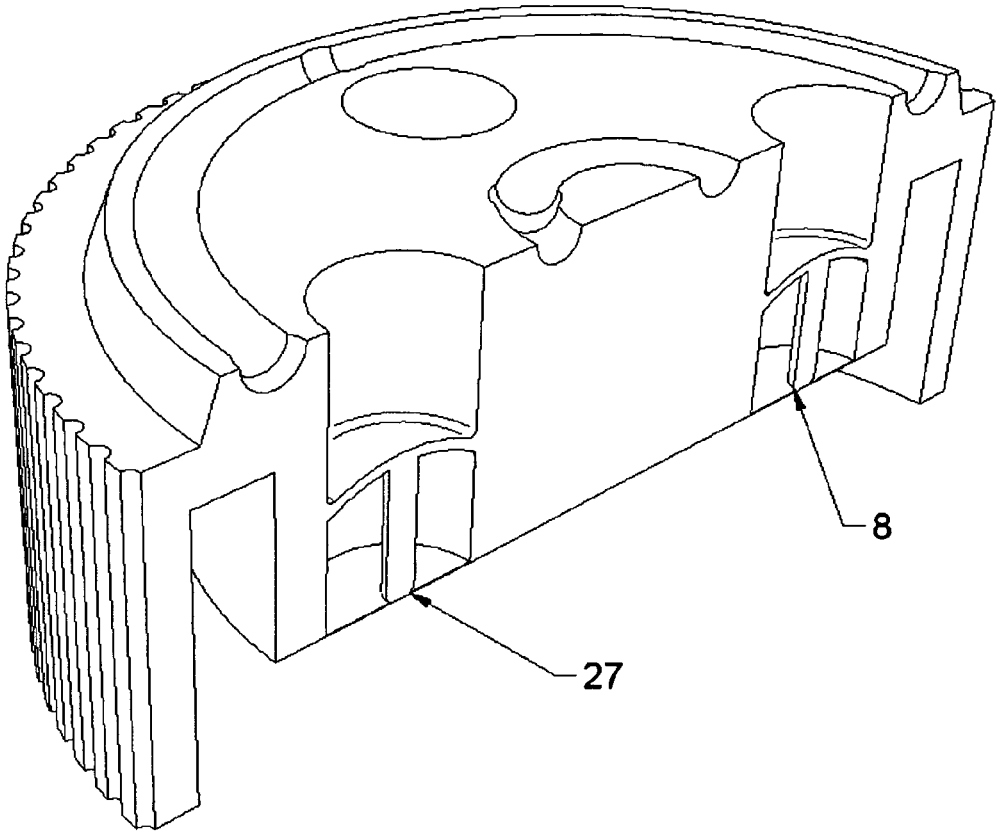
FIG. 4 is an isometric cross sectional view of the bottom portion of the container lid embodiment, illustrating the individual containment vessels and particularly the plungers.
Figure 5:
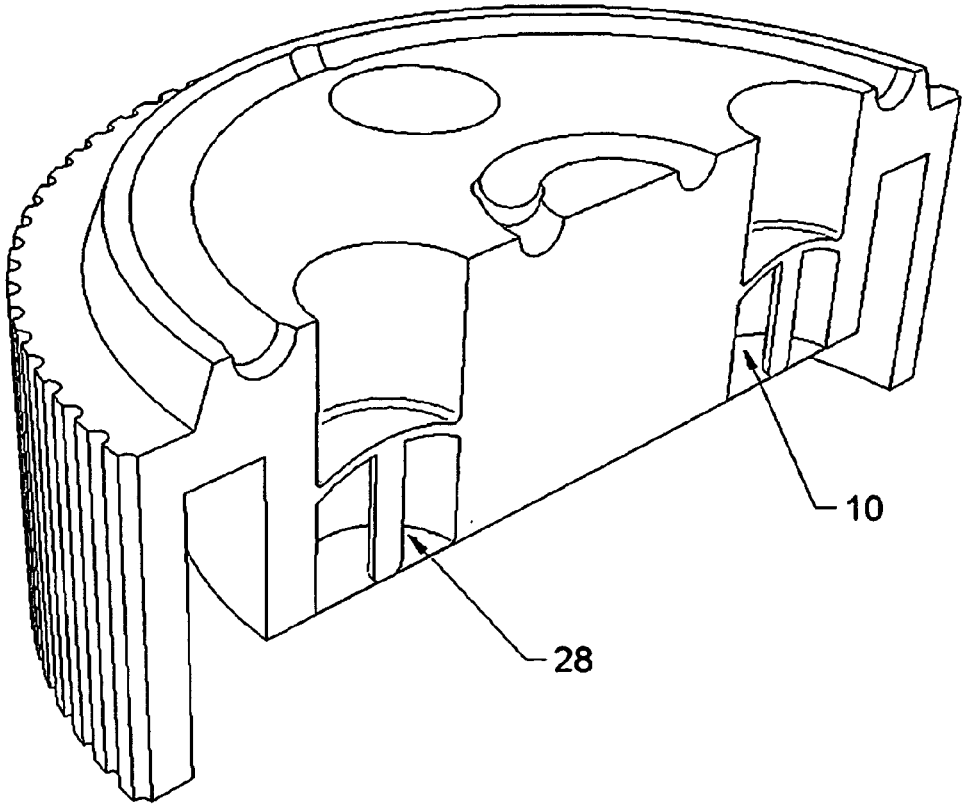
FIG. 5 is an isometric cross sectional view of the bottom portion of the container lid embodiment, illustrating the individual containment vessels and particularly the pistons.
Figure 6:
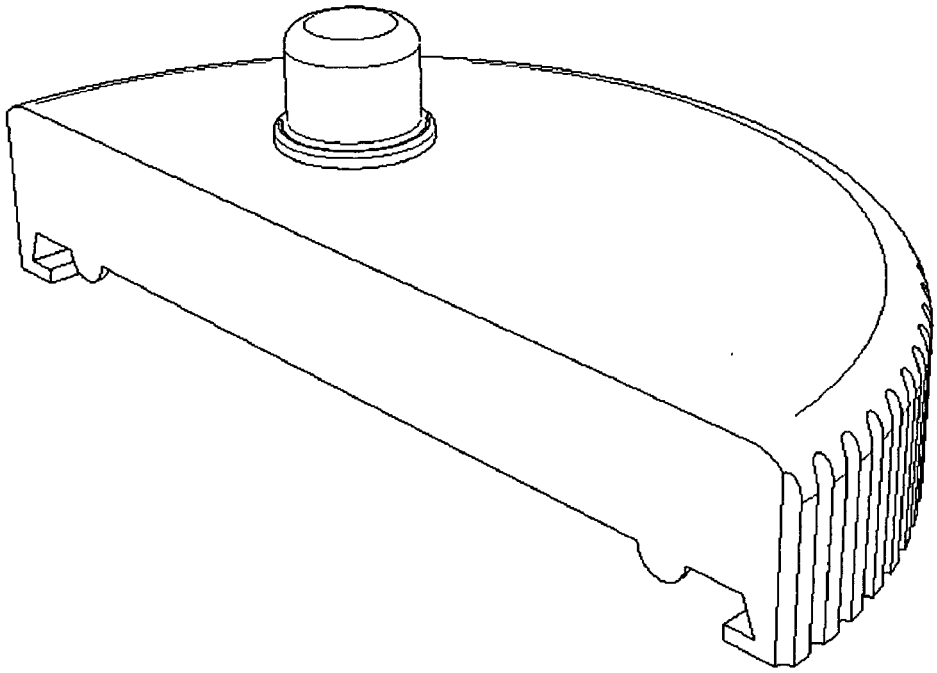
FIG. 6. is a cutaway isometric view of the top portion of container lid embodiment the instant invention.
Figure 7:
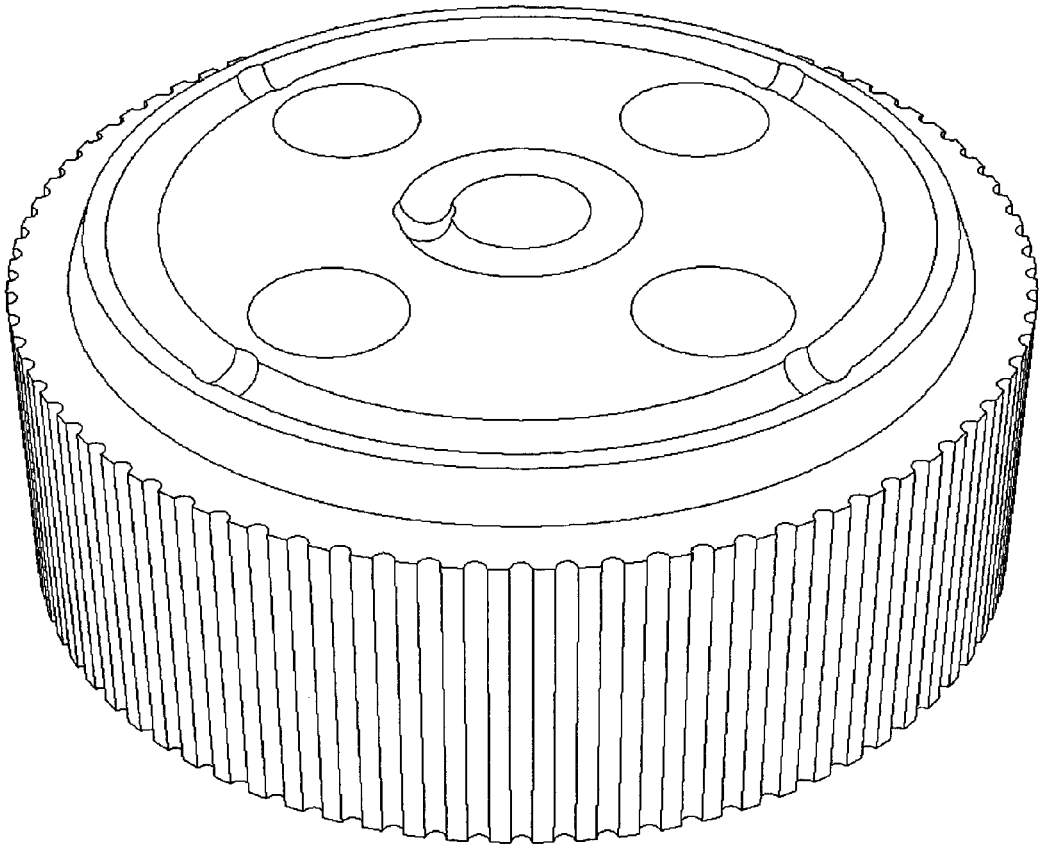
FIG. 7. is an isometric view of the bottom portion of container lid embodiment the instant invention.
Figure 8:
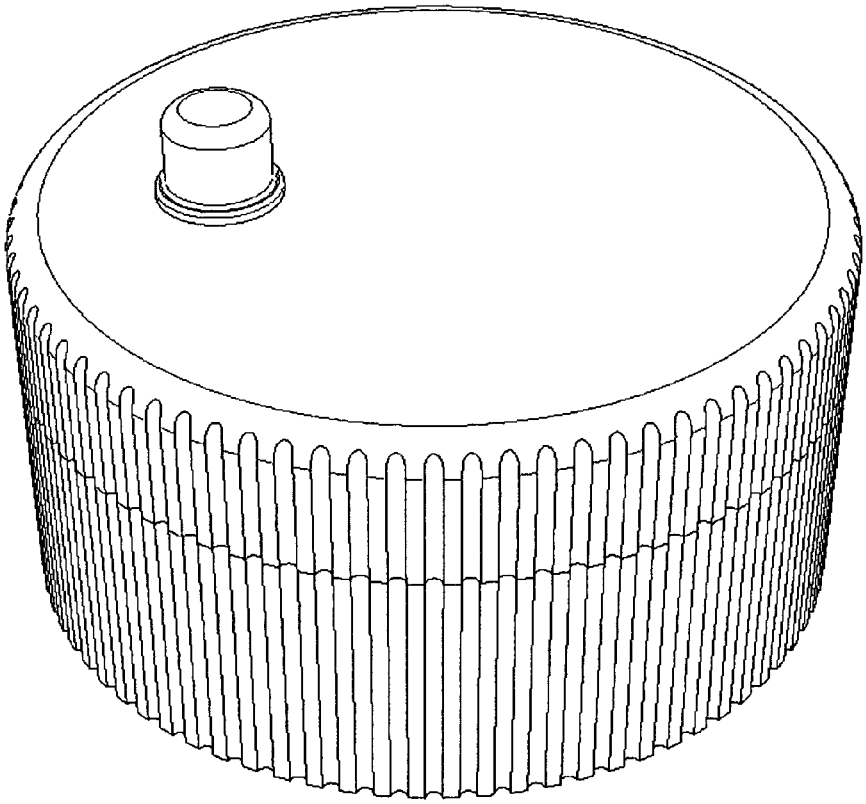
FIG. 8. is an isometric view of container lid embodiment of the instant invention.
Figure 9:
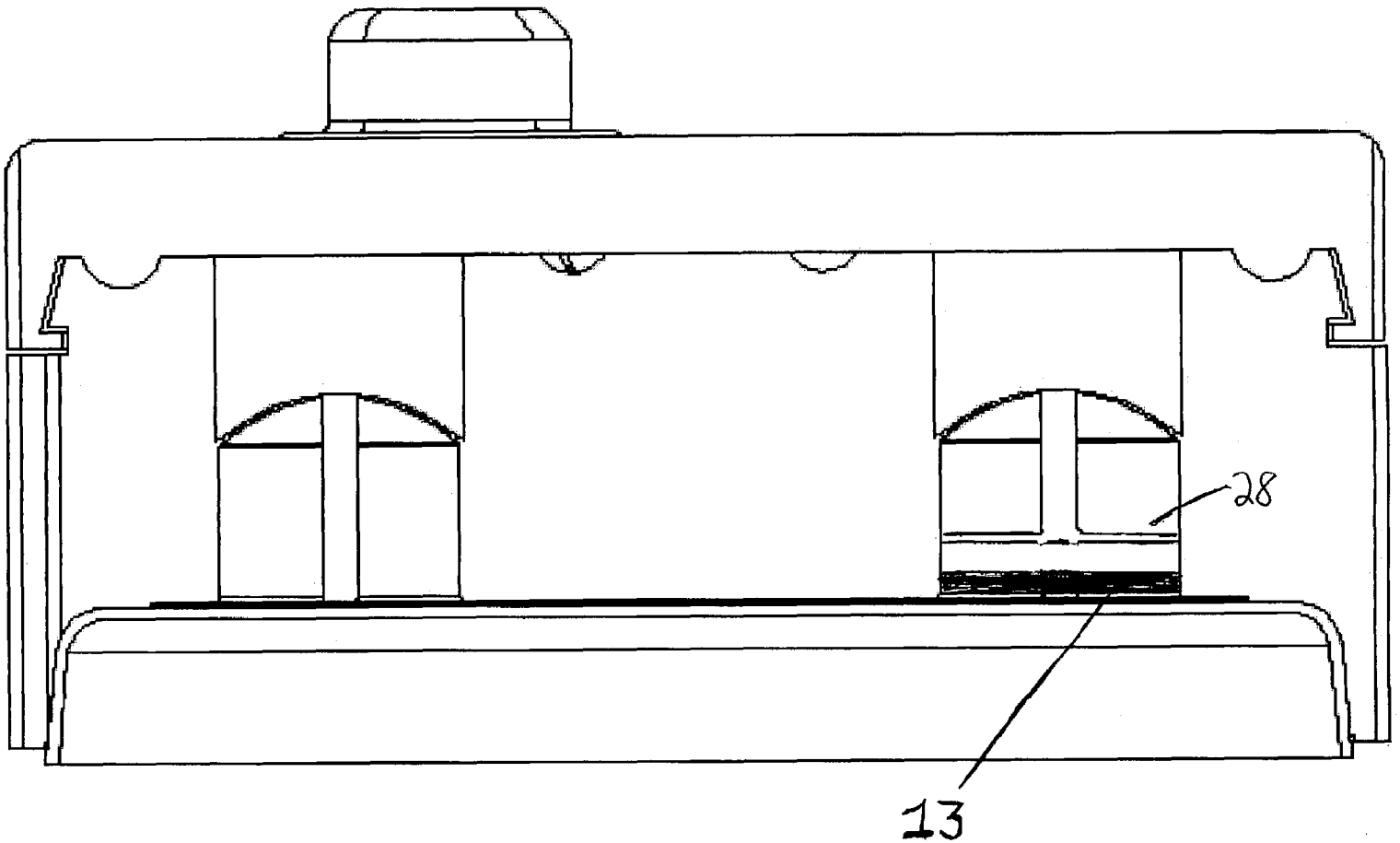
FIG. 9. is a side cross sectional view of container lid embodiment of the instant invention.
Figure 10:
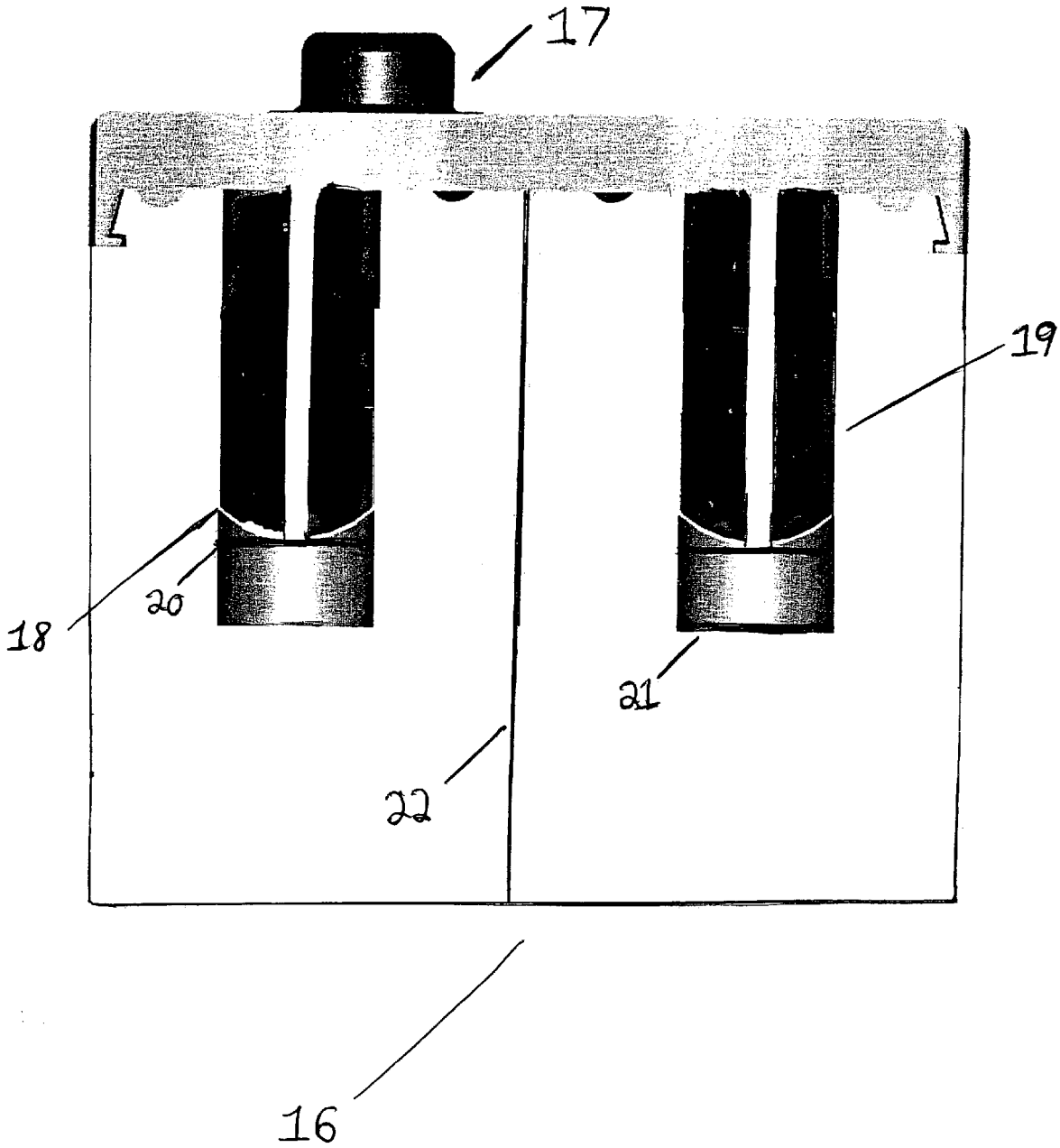
FIG. 10. is a side cross sectional view of container lid embodiment of the instant invention.
Figure 11:
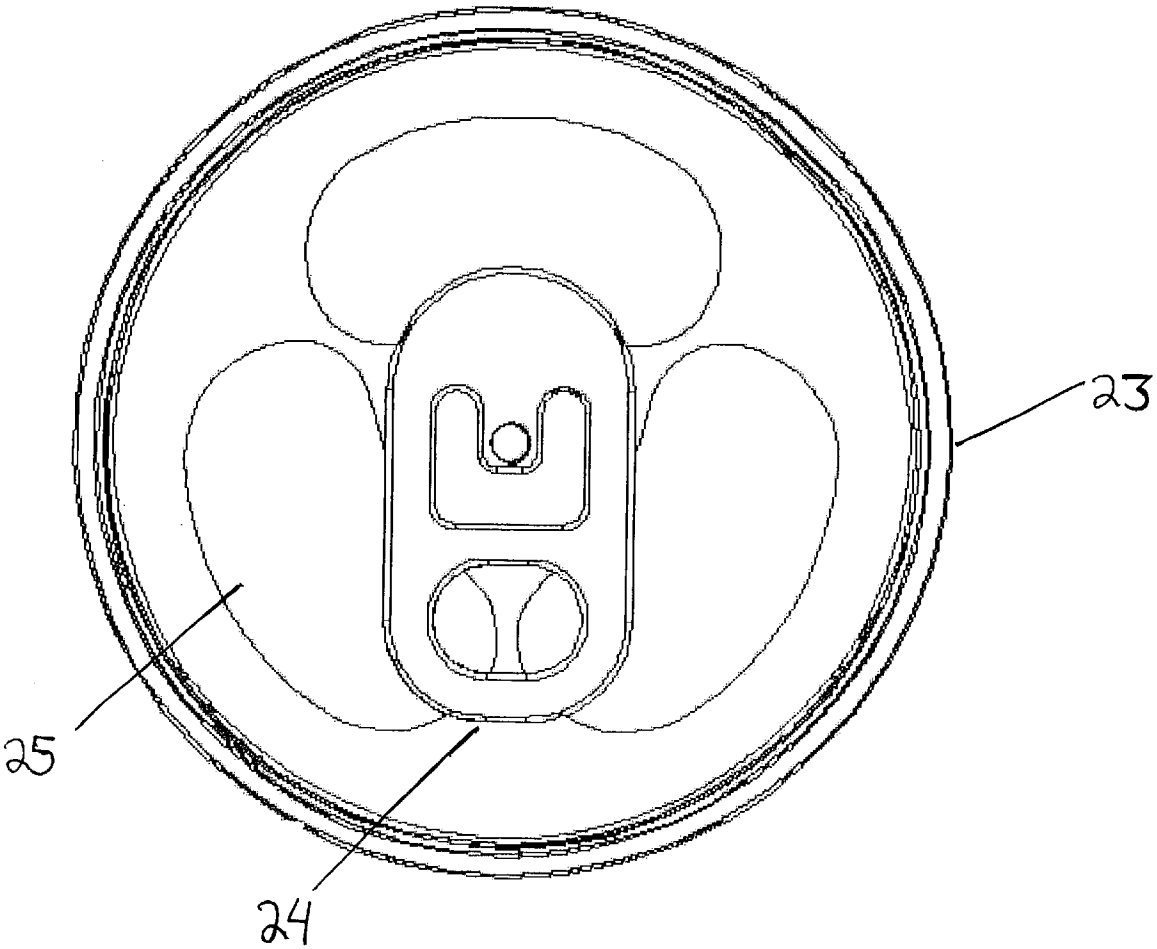
FIG. 11. is a top view of the can embodiment of the instant invention.
Figure 12:
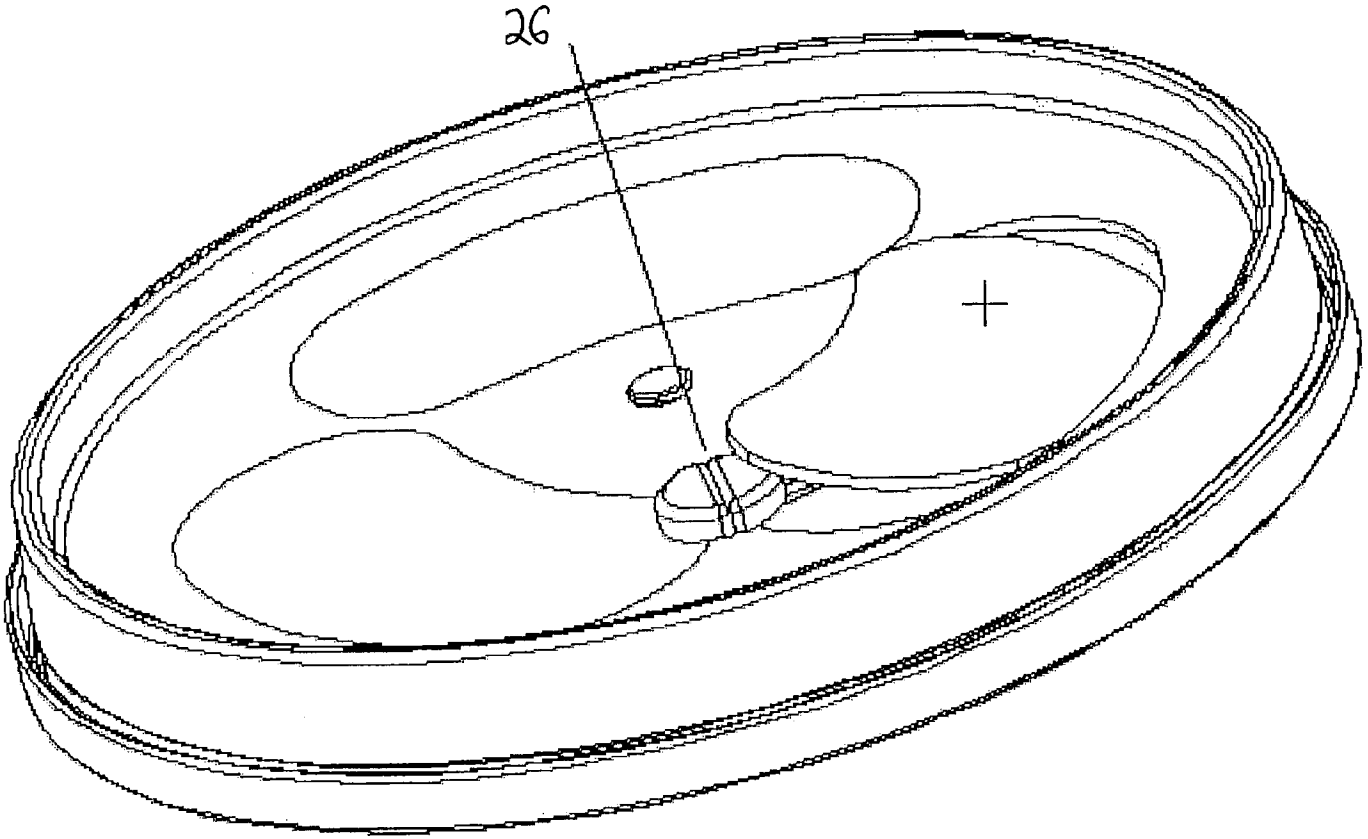
FIG. 12. is an isometric view of the can embodiment of the instant invention illustrating the mixing packets.
Figure 13:
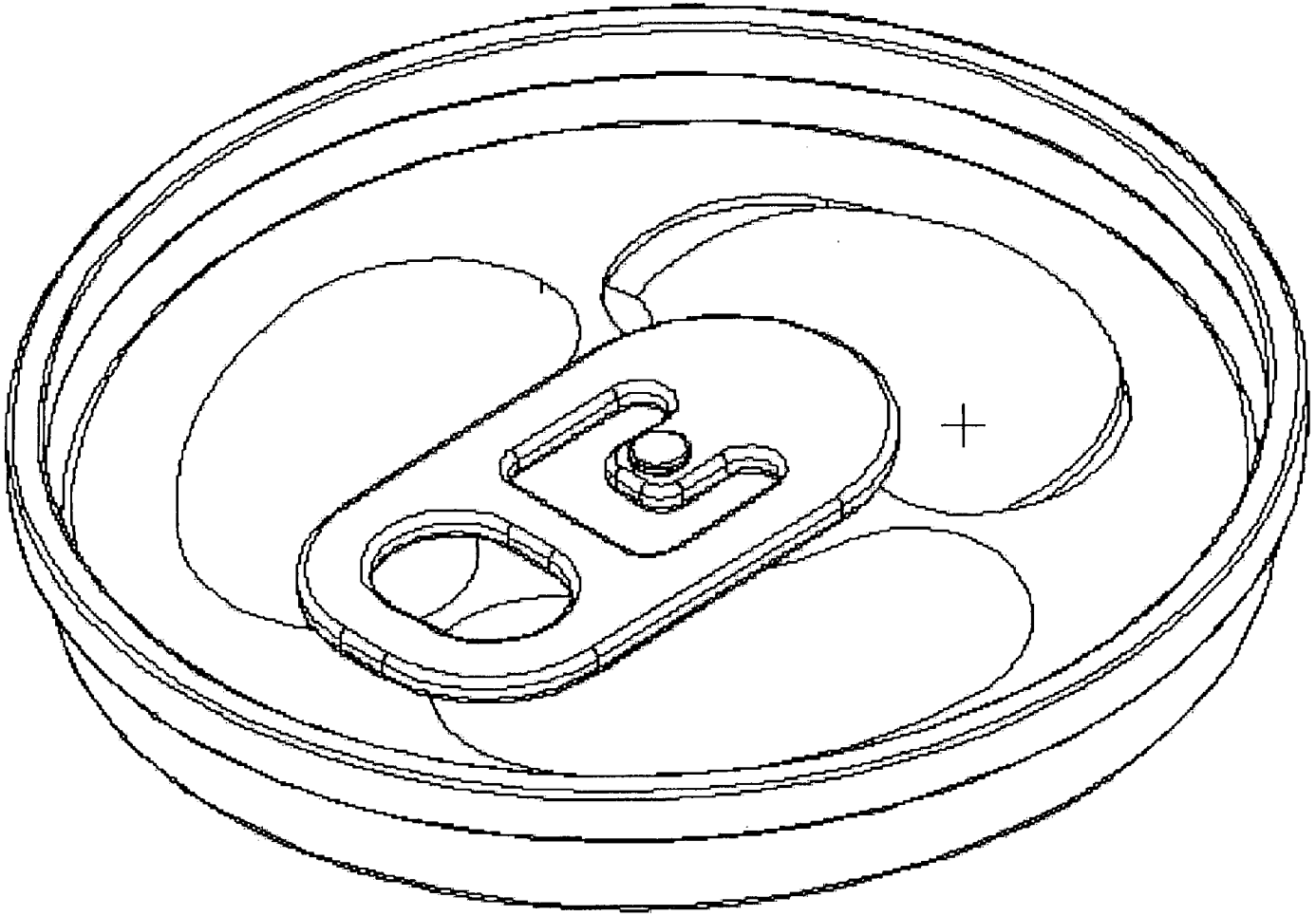
FIG. 13. is an isometric view of the can embodiment of the instant invention illustrating the pivotally connected actuator possessing a blunt edge opening an access port.

The container lid mechanism 1 can be permanently affixed or removable attachable. In operation, the bottom portion 4 of the lid is affixed by any means known in the industry, including but not limited to threading, swaging or clamping the lid to a bottle. Subsequently, as illustrated in FIG. 2, the rotatable top portion 2 actuator 3 is clocked into position and aligned with the containment vessel 7 and the actuator 3 can then be depressed, in turn depressing the plunger mechanism 8.

In one embodiment of the container lid, the plunger mechanism 8 may contain a serrated edge 11 and the seal may comprise a penetrable covering 12. In this configuration, once depression of said actuator 3 occurs, the plunger mechanism 8 utilizing the serrated edge 27 breaches said penetrable covering 12, allowing the substance in the containment vessel or vessels, to be mixed with the substance or substances within the container. In this embodiment, the penetrable covering 12 seal 10 may comprise a foil covering or any other kind of material which is easily penetrable to release substances for mixing.

In a further embodiment of the lid container, the seal may comprise a unidirectional flow valve 13 and upon depression of the actuator 3, the plunger mechanism 8, which in this configuration comprises a piston 28, forces the substance enclosed with the containment vessel out through the unidirectional flow valve 13. The unidirectional flow valve 13 may comprise a check valve or a tensioned flap.

Further, a plurality of containment vessels 14 can be utilized and when present, multiple flavors or substances may be accessed by the user such that blends, mixtures or chemical compounds possessing three or more substances maybe attained. To support this configuration, the rotatable top portion of the lid can be rotated to the desired single or multiple containment vessels and single or multiple containment vessels can be actuated. Further, unlike prior mechanisms, in the instant embodiment, the containment vessels retain the same physical characteristics subsequent to actuation.

When a plurality of containment vessels is employed, an additional feature, an actuator mechanism locking mechanism 15 may exist, as a permanent detent or other such mechanism as known in the art, such that upon activation, the locking mechanism 15 permanently secures the actuator to the plunger. This locking mechanism serves to lock the actuator and plunger in place and consequently, the remaining containment vessels cannot be accessed. Thus ensuring the integrity of solutions, preventing over mixing and ensuring that the system is never reused. Thus, in this configuration, upon initial activation of the system, the actuator may not be rotated again and thus the system utilizes just this one time mixture.

Further, the principles of the containment lid may be adapted to an overall containment vessel embodiment. In this embodiment, an apparatus for mixture of substances exists comprising a global containment vessel 16 a rotatable actuation mechanism 17 located on an external portion of said global containment vessel 16, a locking mechanism 18 in communication with said actuation mechanism, at least one localized containment vessel 19, which may comprise a cylindrical disposed substantially within said global containment vessel 16, a force generation mechanism 20, such as a piston, plunger or the like, which may possess at least one sharp edge on a lower surface, to be disposed within said localized containment vessel and in communication with said actuation mechanism; a unidirectional flow control member 21 disposed within said localized containment vessel and in communication with said force generation mechanism.

Additionally, the at least one localized containment vessel may comprise a plurality of localized containment vessels which may be symmetrically or non-symmetrically arranged. The flow control member may comprise a foil seal or may comprise a unidirectional flow control member possessing an opposing force. In the latter embodiment, the unidirectional flow control member may comprise a check valve or a tensioned flap.

Further, in order to keep substances separate the global containment vessel may comprise at least one divider 22 which creates at least two compartments within said global containment vessel and individual or a plurality of one localized containment vessels may be disposed in each compartment. Moreover, a plurality of dividers may be utilized. With this design, unlike prior designs, the localized containment vessels can be completely immersed in fluid, for more efficient admixture of substances.

Another embodiment illustrates an apparatus for mixture of fluids comprising a lid 23 for a substantially cylindrical member with an internal and external surface, akin to a can. Further, while other inventions utilize a human finger in an inaccurate trigger mechanism, the instant invention utilizes a pivotally connected actuator possessing a blunt edge 24; at least one access area 25; at least one removably attached mixing mechanism 26 disposed entirely on the external surface of the substantially cylindrical member; wherein said blunt edge pierces the compartment and said mixing mechanism can be removed and placed within said substantially cylindrical member. Further, a plurality of access areas and mixing devices may be utilized to add further utility and flexibility to the invention.

The instant invention can easily be molded with current tooling technology. Existing bottle designs can be used with no modifications bottle can be easily recycled it will have no contaminants molded into it environmentally friendly. The can, in the three-hole configuration, may possess 1 to 8 flavors or no flavors at all if desired. This product can be easily dispensed in a vending machine in can or bottle form. All current products have been designed so tooling can be achieved easily and manufactured inexpensively. The instant invention can be manufactured from several materials including but not limited to polymers, composites and flexible metals.

As to a further discussion of the manner of usage and operation of the present invention, the same should be apparent from the above description. Accordingly, no further discussion relating to the manner of usage and operation will be provided. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the substance mixture devices described herein. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A container lid mechanism for mixture of substances comprising:

a rotatable top portion comprising an actuator;

a bottom portion comprising:

a top edge in communication with said rotatably attachable top portion;

at least one containment vessel;

at least one plunger mechanism encased within said at least one containment vessel and in communication with said actuator;

a lower edge; and, a seal in communication with said lower edge and wherein said plunger mechanism further comprises a piston and said seal further comprises a unidirectional flow valve.

2. The container lid for mixture of substances of claim 1 wherein upon depression of said actuator, said plunger expels a substance within said containment vessel through said unidirectional flow valve.

3. The container lid for mixture of substances of claim 2 wherein said at least one containment vessel comprises a plurality of containment vessels.

4. A container lid mechanism for mixture of substances comprising:

a rotatable top portion comprising a separately rotatable actuator;

a bottom portion comprising:

a top edge in communication with said rotatably attachable top portion;

a plurality of containment vessels having at least one plunger mechanism encased within each containment vessel, wherein said actuator may be rotatably aligned to communicate with an individual containment vessel;

a lower edge; and, a seal in communication with said lower edge.

5. The container lid mechanism for mixture of substances of claim 4 wherein said container lid mechanism is removably attachable.

6. The container lid for mixture of substances of claim 4 wherein said actuator mechanism further comprises a locking mechanism.

7. The container lid for mixture of substances of claim 4 wherein said plunger mechanism further comprises a serrated edge.

8. The container lid for mixture of substances of claim 7 wherein said seal further comprises a penetrable covering.

9. The container lid for mixture of substances of claim 8 wherein upon depression of said actuator, said plunger breaches said penetrable covering.

* * * * *